US009475679B2

(12) United States Patent
Copin

(10) Patent No.: US 9,475,679 B2
(45) Date of Patent: Oct. 25, 2016

(54) CHAIN HOIST

(71) Applicant: Konecranes Plc, Hyvinkää (FI)

(72) Inventor: Fabrice Copin, Vernouillet (FR)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 0 days.

(21) Appl. No.: 14/481,610

(22) Filed: Sep. 9, 2014

(65) Prior Publication Data

US 2016/0068378 A1 Mar. 10, 2016

(51) Int. Cl.

| | |
|---|---|
| ***B66D 3/24*** | (2006.01) |
| ***B66D 3/20*** | (2006.01) |
| ***B66D 3/26*** | (2006.01) |
| *B66D 1/56* | (2006.01) |

(52) U.S. Cl.
CPC . *B66D 3/24* (2013.01); *B66D 3/20* (2013.01); *B66D 3/26* (2013.01); *B66D 1/56* (2013.01)

(58) Field of Classification Search
CPC ..... B66D 1/46; B66D 1/48; B66D 1/485; B66D 1/56; B66D 1/60; B66D 1/72; B66D 3/24; B66D 3/26; B66D 3/20; A63J 1/02
See application file for complete search history.

(56) References Cited

U.S. PATENT DOCUMENTS 2,428,578 A * 10/1947 Nelles ..... B66D 1/56 24/114.5
3,318,575 A * 5/1967 Hawkins ..... B66C 1/34 267/141
3,810,359 A * 5/1974 Schreyer ..... F16G 17/00 254/391
4,398,387 A * 8/1983 Bary ..... B66D 3/16 254/371
5,644,821 A * 7/1997 Zaguroli, Jr. ..... B66D 3/24 24/114.5
2014/0319440 A1* 10/2014 Kataoka ..... B66D 3/20 254/334

FOREIGN PATENT DOCUMENTS

EP 2466252 A1 * 6/2012 ..... B66D 1/46

OTHER PUBLICATIONS

"Stagemaker New SR Raising the Standard of Perfection", www.Stagemaker.com, specifications of 2013 Stagemaker SR.*
"Konecranes Awarded in Red Dot, One of the Most Internationally Acclaimed Design Competitions", Mar. 18, 2013, http://globenewswire.com.*
Brochure from Stagemaker dated Mar. 12, 2014.

* cited by examiner

*Primary Examiner* — Sang Kim
*Assistant Examiner* — Nathaniel Adams
(74) *Attorney, Agent, or Firm* — Birch, Stewart, Kolasch & Birch, LLP

(57) ABSTRACT

A chain hoist includes a body; a hoist chain passing through the body; through-holes in the body for the hoist chain; and an actuator arrangement for operating the chain hoist, the actuator being used for moving the hoist chain through said through-holes in a lifting or lowering direction of the chain hoist, and on the side of at least one through-hole the portion of the hoist chain moving outside the body is provided with a limiter member whose position in the longitudinal direction of the hoist chain is adjustable, the limiter member being provided with a detectable sensor; and a sensor detection member is provided in the vicinity of said through-hole to detect the detectable sensor at a predetermined distance.

8 Claims, 1 Drawing Sheet

CHAIN HOIST

BACKGROUND OF THE INVENTION

The invention relates to a chain hoist comprising a body; a hoist chain passing through the body; a first through-hole in the body for the hoist chain; a second through-hole in the body for the hoist chain; an actuator arrangement for operating the chain hoist, the actuator being used for moving the hoist chain through said through-holes in a lifting or lowering direction of the chain hoist.

A chain hoist of the invention is used particularly in theatre applications or the like in which an object to be lifted, such as a scenic object, must be lifted or lowered rapidly and precisely to the correct height.

In prior art solutions the correct height must be estimated by the eye and the hoist must be stopped on the basis of this, usually inaccurate, estimate which means that corrective moves have to be made. In connection with this, accidents may happen due to the object to be lifted hitting something and thus damaging both the object and the environment. In the worst case scenario personal injury may occur.

SUMMARY OF THE INVENTION

An object of the invention is to provide a novel chain hoist so as to enable the above-described problems to be solved. This is achieved by a chain hoist of the invention, characterized in that on the side of at least one through-hole the portion of the hoist chain moving outside the body is provided with a limiter member whose position in the longitudinal direction of the hoist chain is adjustable, the limiter member being provided with a detectable sensor; and a sensor detection member is provided in the vicinity of said through-hole to detect the detectable sensor at a predetermined distance.

The sensor detection member most preferably communicates directly with the actuator arrangement for stopping the chain hoist when the limiter member and the sensor provided therein are at said detection distance from the sensor detection member.

Other preferred embodiments of the invention are disclosed in the dependent claims.

With the chain hoist of the invention all hoists can be made precisely to the right position after the lifting heights have been determined by the limiter member that is preferably slidable on the hoist chain and lockable to a desired position, the sensor in the limiter member and the sensor in the body then co-operating to provide a stop command to the chain hoist actuator. The invention provides such precision that the limiter member may be stopped at a distance of one chain loop from the hoist body. This allows an automated lifting height to be determined with extreme precision.

The solution of the invention is simple by design and affordable to implement, and it is also suitable for retrofitting existing chain hoists. In addition to the uses mentioned at the beginning, also industrial applications of the chain hoist are possible.

LIST OF FIGURES

Figure 1:
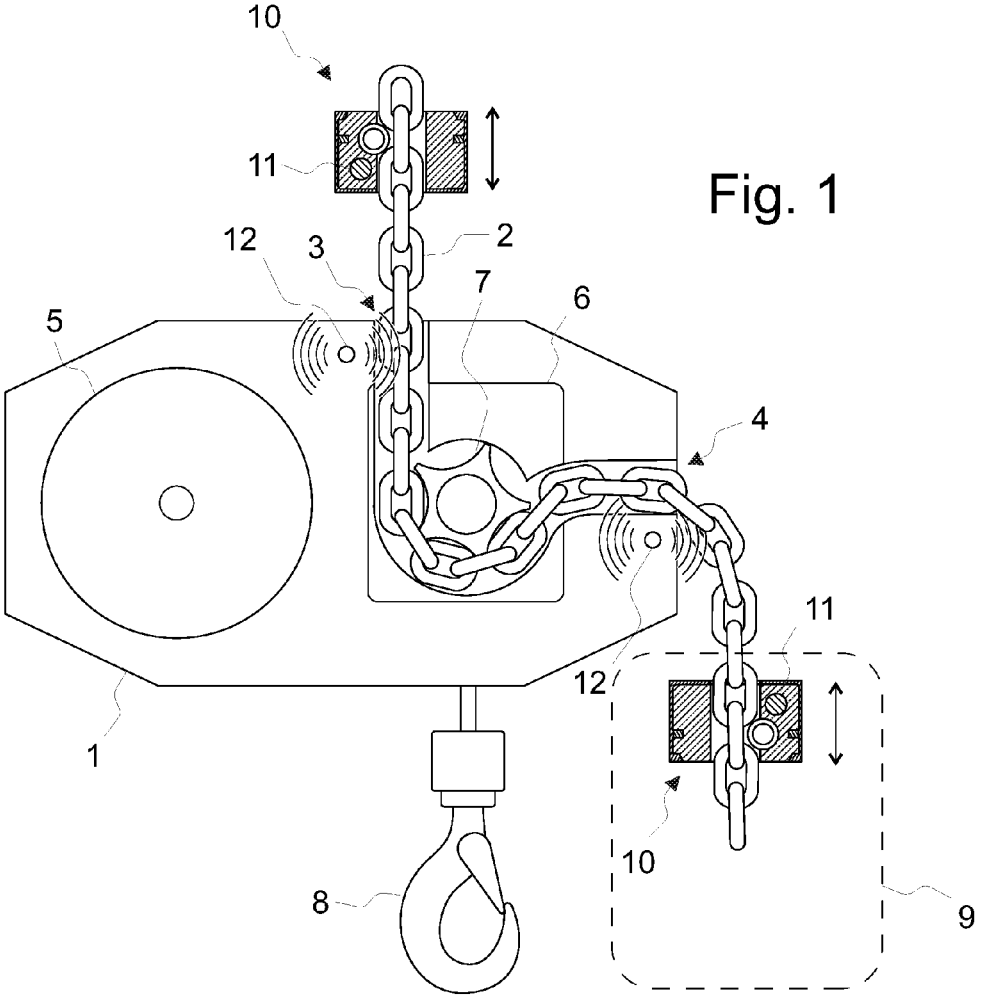
Figure 2:
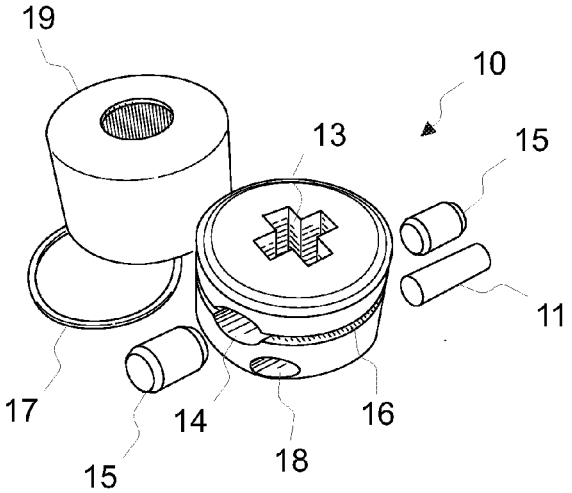

The invention is now described in closer detail by means of one preferred embodiment and with reference to the accompanying drawings, in which FIG. 1 is a cross-sectional view of a chain hoist of the invention; and FIG. 2 is an explosion view of a limiter member visible in FIG. 1.

DETAILED DESCRIPTION OF THE INVENTION

With reference to FIG. 1, a chain hoist of the invention comprises a body 1; a hoist chain 2 passing through the body 1; a first, upper, through-hole 3 in the body 1 for the hoist chain 2; a second, lower, through-hole 4 in the body 1 for the hoist chain 2, and an actuator arrangement 5, 6, 7 (an electric motor 5, a gear 6 and a chain wheel 7) for operating the chain hoist, the arrangement being used for moving the hoist chain 2 through the through-holes 3 and 4 in a lifting or lowering direction of the chain hoist. In this application the through-hole 3 is on an upper surface of the body 1 and the through-hole 4 on a side surface of the body 1. In this application a lifting hook 8 needed in the lifting is attached to an underside of the body 1. The top end of the hoist chain 2 is fastened to a support structure (not shown) provided up in the lifting space by e.g. a second lifting hook (not shown) fastened to the top end of the hoist chain 2. During lifting, the body 1 and the lifting hook 8 move along the hoist chain 2, excess hoist chain 2 being collected into and released from a chain bag 9 arranged below the through-hole 4. Of course, the chain hoist may also be used in a "reverse mode", i.e. by fastening it to said support structure of the lifting space by the lifting hook 8, the body 1 of the chain hoist being thus stationary and the hoist chain 2 being "reeled" into or out of the body 1 with the chain bag 9 being used also in this case for collecting excess hoist chain 2.

An essential aspect of the chain hoist of the invention is that on the side of at least one through-hole 3, 4 the portion of the hoist chain 2 moving outside the body 1 is provided with a limiter member 10 whose position in the longitudinal direction of the hoist chain 2 is adjustable, the limiter member being provided with a detectable sensor 11; and that a sensor detection member 12 is provided in the vicinity of the through-hole 3, 4 to detect the detectable sensor 11 at a predetermined distance. In this example the limiter member 10 and the detectable sensor 11 are arranged on each part of the hoist chain 2 moving outside the through-holes 3, 4 and the sensor detection member 12 is arranged inside the body 1 at the immediate vicinity of the through-holes 3, 4.

The detectable sensor 11 may be e.g. a magnet and the sensor detection member 12 may be a magnet detector. Also other commonly known detection pairs recognizing one another are possible.

The sensor detection member 12 is configured to communicate directly with the actuator arrangement 6, 7, 8 for stopping the chain hoist when the limiter member 10 and the sensor 11 provided therein are at said detection distance from the sensor detection member 12. This detection distance may be as short as the distance corresponding to a length of one chain loop.

For the limiter member 10 to be easily slidable on the hoist chain 2 and lockable to a desired point there, the limiter member 10 is provided with locking members that press against the hoist chain 2 in a resilient manner.

The limiter member 10 is preferably a cylinder with an axial through-hole 13 for the hoist chain 2, a transverse hole 14 running through the cylinder 10 and intersecting the through-hole 13, locking pins 15 placed in the transverse hole 14 and pressing against the hoist chain 2 on both sides thereof; a peripheral groove 16 running on the outer surface of the cylinder 10 at the transverse hole 14; a resilient locking ring 17 placed into the peripheral groove 16 to keep the locking pins 15 in place in a resilient manner; and a space 18 (drilling) for the sensor 11. In addition, around this assembly there is a resilient rubber cover 19 which also ensures that the above components stay in place.

The above description of the invention is only intended to illustrate the basic idea of the invention. A person skilled in the art may thus vary its details within the scope of the attached claims.

The invention claimed is:

1. A chain hoist, comprising:

a body;

a passage extending through the body;

a hoist chain passing through the passage;

an actuator within the body, the actuator providing relative movement between the body and hoist chain; and a limiter member, in a form of a cylinder, attached to the hoist chain, the limiter member being provided with a detectable sensor, wherein the body has a sensor detection member to detect the detectable sensor at a predetermined distance from the sensor detection member, and wherein the limiter member comprises:

an axial through-hole for the hoist chain;

a first transverse hole running through the cylinder and intersecting the axial through-hole;

a pair of locking pins placed into the first transverse hole and pressing against the hoist chain on both sides thereof to releasable fix the limiter member to the hoist chain;

a peripheral groove extending around the entire periphery of an outer surface of the cylinder, overlapping with the first transverse hole;

a resilient locking ring placed into the peripheral groove, running over the pair of locking pins and pressing the pair of locking pins in place in a resilient manner; and a second transverse hole formed on the outer surface of the cylinder, wherein the detectable sensor is received in the second transverse hole.

2. A chain hoist, comprising:

a body;

a hoist chain passing through the body;

a first through-hole in the body for the hoist chain;

a second through-hole in the body for the hoist chain;

an actuator arrangement for operating the chain hoist, the actuator being used for moving the hoist chain through the first and second through-holes in a lifting or lowering direction of the chain hoist;

a limiter member attached to the hoist chain, the limiter member being provided with a detectable sensor; and the body having a sensor detection member to detect the detectable sensor at a predetermined distance from the sensor detection member, wherein the limiter member is a cylinder comprising:

an axial through-hole for the hoist chain;

a first transverse hole running through the cylinder and intersecting the axial through-hole;

a pair of locking, pins placed into the first transverse hole and pressing against the hoist chain on both sides thereof to releasable fix the limiter member to the hoist chain;

a peripheral groove extending around the entire periphery of an outer surface of the cylinder, overlapping with the first transverse hole;

a resilient locking ring placed into the peripheral groove, running over the pair of locking pins and pressing the air of locking pins in place in a resilient manner; and a second transverse hole formed on the outer surface of the cylinder, wherein the detectable sensor is received in the second transverse hole.

3. The chain hoist as claimed in claim 2, wherein the sensor detection member communicates directly with the actuator arrangement for stopping the chain hoist when the limiter member and the detectable sensor provided therein are at the predetermined distance from the sensor detection member.

4. The chain hoist as claimed in claim 2, wherein the sensor detection member is placed inside the body.

5. The chain hoist as claimed in claim 2, wherein the detectable sensor is a magnet and the sensor detection member is a magnet detector.

6. The chain hoist as claimed in claim 3, wherein the sensor detection member is placed inside the body.

7. The chain hoist as claimed in claim 3, wherein the detectable sensor is a magnet and the sensor detection member is a magnet detector.

8. The chain hoist as claimed in claim 4, wherein the detectable sensor is a magnet and the sensor detection member is a magnet detector.

* * * * *